United States Patent [19]

Sengewald

[11] Patent Number: 4,781,471

[45] Date of Patent: Nov. 1, 1988

[54] METHOD AND ARRANGEMENT FOR PRODUCING BAGS, SACKS OR SIMILAR OBJECTS OF A THERMOPLASTIC SYNTHETIC PLASTIC FOIL WEB, AND OBJECTS PRODUCED THEREBY

[76] Inventor: Karl-Heinz Sengewald, Kreisstrasse 16, 4802 Halle in Westfalen, Fed. Rep. of Germany

[21] Appl. No.: 24,374

[22] Filed: Mar. 10, 1987

[30] Foreign Application Priority Data

Jul. 18, 1986 [DE] Fed. Rep. of Germany ..... 3624311

[51] Int. Cl.[4] ..... B65D 30/02

[52] U.S. Cl. ..... 383/7; 383/10; 383/37; 229/69

[58] Field of Search ..... 383/6, 7, 10, 37; 229/69; 53/562

[56] References Cited

U.S. PATENT DOCUMENTS

| | | | |
|---|---|---|---|
| 3,079,292 | 2/1963 | Garth | 383/7 |
| 3,548,723 | 12/1970 | Sengewald | 383/10 |
| 3,850,724 | 11/1974 | Lehmacher | 383/10 |

*Primary Examiner*—Willis Little

*Attorney, Agent, or Firm*—Michael J. Striker

[57] ABSTRACT

In accordance with a method and an arrangement for producing bags, sacks or similar objects, and in a synthetic plastic material for its production, a plurality of printing marks are arranged on a supporting foil, and then the supporting foil is attached to the synthetic plastic material, for example by gluing.

16 Claims, 2 Drawing Sheets

FIG. 4
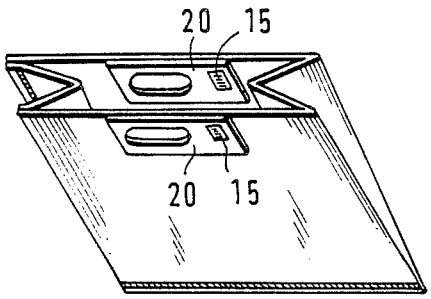
FIG. 5
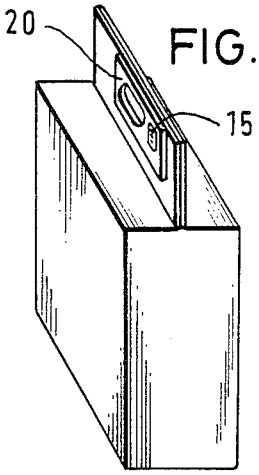
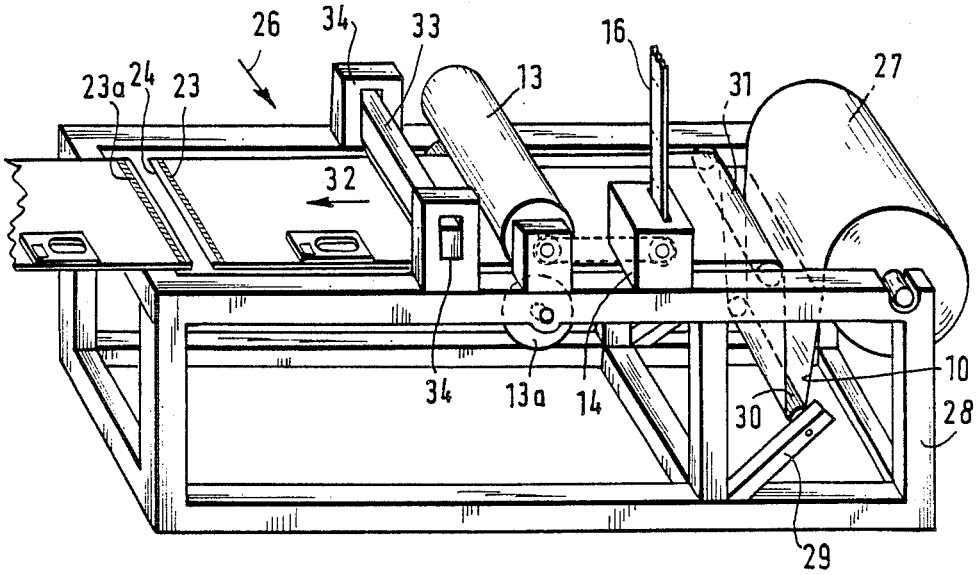
FIG. 6

METHOD AND ARRANGEMENT FOR PRODUCING BAGS, SACKS OR SIMILAR OBJECTS OF A THERMOPLASTIC SYNTHETIC PLASTIC FOIL WEB, AND OBJECTS PRODUCED THEREBY

BACKGROUND OF THE INVENTION

The present invention relates to a method of and an arrangement for producing bags, sacks or similar objects of a thermoplastic synthetic plastic foil web. The present invention also relates to bags, sacks or similar articles as well as to a synthetic plastic foil web and a foil strip with printing marks for their production.

It is known to produce bags, sacks or similar objects of a thermoplastic synthetic plastic foil web by welding and separating the latter, in acordance with which these steps are controlled by printing marks provided on the synthetic plastic foil web. The printing marks are sensed by photoelectric control or similar devices for controlling the welding and separation. Synthetic plastic foil webs, bags, sacks or similar objects, and foil strips with printing marks are also known in the art. Bags, sacks, or similar objects produced from a thermoplastic synthetic plastic foil are printed in many cases. The printing is performed at the end of the production of the synthetic plastic foil web in an extruder, mainly after the blowing process. In many cases multiple color printing is used. With such color synthetic plastic foils webs it is necessary to arrange the color imprints on the finished bag, sack or similar object, always at the same location, for example so that they are arranged at a predetermined distance from the upper and lower edges.

For achieving this, printing marks are attached to the foil web with its printing. They are controlled by photoelectrical means or similar devices so as to provide a proper alignment of the printing image on the finished bag or sack. With the aid of the printing marks also the local position and the time of processing is controlled, so that for example, the longitudinal and transverse weldings with the separating cuts, or also the fitting steps and providing of the closing seam are achieved on the correct location.

For printing the thermoplastic synthetic foil web, a preceding electronic processing is required. This electronic processing reduces the capability for welding of the foil web. When the foil web starts from a hose or a cut hose and then forms from a flat web, and then the hose is provided with side folds, the electronic processing interferes with the welding in the region of the side folds.

Synthetic plastic foil web processing machines for producing bags, sacks or similar objects are provided with photoelectrical control devices or similar electronic devices which control printing marks attached by printing of the foil web and respectively determine nonmechanically the length of the bag, sack or similar object. Thereby these machines are not suitable for processing non-printed foil webs.

On the other hand, there are bags, sacks or similar objects from non-printed foils which require certain distances inside the bag for controlling the welding and separating device, for example the distance of a gripping opening from a filling opening or a transverse welding. For maintaining these distances with the required safety it was necessary to print printing marks on the foil web. The printing of the printing marks, however, requires, even in a small region, the electronic processing of the foil over its entire length, wherefore a significant labor is needed. Such a synthetic plastic foil web which is electronically processes and provided with printed printing marks is limited in its use, since the distances of the printing marks from one another and their distance from the edge of the foil web can be used only for certain formats of bags or sacks.

SUMMARY OF THE INVENTION

Accordingly, it is an object of the present invention to avoid the disadvantages of the prior art.

More particular, it is an object of the present invention to use the modern machines with photoelectrical or similar electronic sensing means for sensing printing marks on printed foil webs, also for unprinted foil webs, with simple and cost favorable means.

In keeping with these objects and with others which will become apparent hereinafter, one feature of the present invention resides, briefly stated, in a method of producing of bags, sacks or similar objects from a thermoplastic synthetic plastic foil web with welding and separating controlled by printing marks sensed by photoelectrical control devices or similar devices, wherein in accordance with the invention the printing marks are first arranged on a supporting foil and then the supporting foil is attached to the thermoplastic synthetic foil web, for example by adherence [gluing].

When the method is performed in accordance with the present invention, the foil web is provided with the printing marks in a simple manner by gluing. The inventive proposal guarantees that the printing marks can be brought by gluing with simple means on any place or on variable places on the synthetic plastic web, so that they can be arranged in a variable distance from the edge and in variable distance from one another. By gluing the printing marks at any place on the synthetic plastic foil web so that the printing marks are respectively easily detectable by electronic sensing means, a simple adjustment of the bag or sack or similar object to be produced is achieved.

The inventive solution in accordance with which the printing marks are glued on associated foil-like supports on the synthetic plastic foil web provides for a further advantage in that the glued printing marks, while failing available contrast because of color printing, can be easily controllable so that in this sense a further simplification or reliability of sensing is achieved.

Since in accordance with the inventive solution the adhered printing marks in the event of failures very reliably correspond to a respective color print, they can be dimensioned very small or brought at concealed locations of the foil web. This means that in the finished bag, sack or similar object they are not noticeable.

The term "similar object" can also means packages. It also includes objects which can be produced with the aid of a thermoplastic instead of plastic foil and which are not packages. For example, it can include bed coating for hospital beds which are composed of wool fabric connected with a substrate of a thermoplastic synthetic plastic material. This can also include packages which are composed of combination of paper webs with synthetic webs, for example for packing medical instruments which must be sterilized in autoclaves. In these objects, particularly in bag coatings, a printing of the synthetic plastic foil webs are not desirable. The inventive solution here has a special advantage.

It is not absolutely necessary to arrange the printing marks one after the other on an associated support. They can be for example stacked over one another. The inventive solution allows many deviations and modifications.

It is especially advantageous when the printing marks are arranged one after the other on a long small support strip and the support strip is connected with the synthetic plastic foil web by gluing. This solution makes possible to supply continuously the strip with the printing marks and to attach over the length of the foil web. In many cases this can be advantageous. The strips which carry the printing marks do not have to be small, but they can have a certain width and respective print. Since it is relatively small or in special applications wider and is connected by a gluing with the synthetic plastic foil, it is guaranteed that it does not hinder welding of the synthetic plastic foil web.

In accordance with a further embodiment of the invention it is proposed that the supporting strip with the printing mark to be applied on the synthetic plastic foil web in a respective portion carries the printing marks and the applied portion determines the length of the bag or a similar object. A solution has the advantage of a simple gluing with the synthetic plastic foil web.

The strip which carries the printing marks can be provided with an adhesive layer which is coated by a known coating foil. In accordance with a further embodiment of the invention, it is proposed that the carrying strip with the printing marks is provided shortly before its connection with the synthetic plastic foil web, with an adhesive [glue] at its rear side.

The separation of individual portions of the strip provided with the printing marks can be performed by a cutter. It is especially advantageous in accordance with a further feature of the present invention that the strip with the printing marks is provided with a tearing perforation between the printing marks.

The attachment of the printing marks on the synthetic plastic foil web can be performed directly after the production of the synthetic plastic foil web by casting, extrusion or blowing to a hose before its winding to a roll.

It is also proposed in an especially advantageous manner that the attachment of the printing mark by gluing on the synthetic plastic foil web is carried out in a processing machine which processes the synthetic plastic foil web to make bags, sacks or similar objects. This solution is to provide the machine with supply means which attach by gluing the printing marks on a supporting foil of paper or synthetic plastic, on the synthetic plastic foil web. This has the advantage that the glued printing marks can be applied on the synthetic plastic foil web with special consideration of the condition of the machine, so that they can be detected by sensing devices in special conditions in a simple and reliable manner. Also, with simple means, an adjustment to a respective format of the bag or sack or similar object is possible since the printing mark supplying means is arranged adjustably on the foil processing machine. This adjustment can be achieved in particular with respect to the longitudinally extending edge of the foil processing machine, but at a distance from the welding and separating device which extends transversely to the traveling direction of the synthetic plastic foil web during its processing.

The inventive solution can be used on synthetic plastic foil processing machines which operate continuously, in accordance with a known rotary system in which a rotatable drum cooperates with an outwardly operating welding and separating device. In this rotary system the foil web provided with the attached printing marks can be processed and the printing marks can be attached by gluing.

The inventive solution is especially advantageous for many commericial synthetic plastic foil processing machines with intermittent operation. Such machines have a supporting block which supports a supply roll of the synthetic plastic foil web, and the movement compensating device which provides compensation between continuous winding of the supply web and an intermittent operation of a welding and separating device. The welding and separating device is arranged before a pair pulling rollers as considered in the movement direction of the synthetic plastic foil web. The pulling rollers move the synthetic plastic foil web intermittently, so that during the operation of the welding and separating device the synthetic plastic foil does not move. At this time of immovability of the synthetic plastic foil web is especially advantageous, as well as the time interval during which the printing mark supporting portion of the strip composed of a synthetic foil or preferably of paper is connected by gluing to the synthetic plastic foil web.

The novel features which are considered as characteristic for the invention are set forth in particular in the appended claims. The invention itself, however, but as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a view showing a carrying pocket or case in a perspective showing;

FIG. 5 is a view showing a bag in a perspective showing; and

FIG. 6 is a perpsective view of a bag producing machine in accordance with the invention.

DESCRIPTION OF PREFERRED EMBODIMENTS

Figure 1:
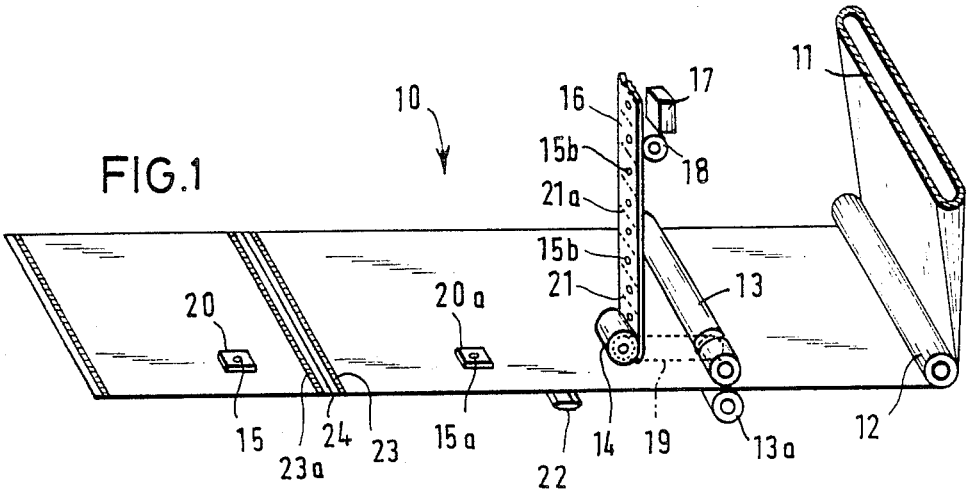
FIG. 1 is a perspective view schematically showing application of printing marks on a synthetic plastic foil web.

FIG. 1 shows a synthetic plastic foil web 10 which is formed as a hose 11 and is supplied from a blow extruder. The hose 11 is deflected by a deflecting roller 12. A pair of pulling rollers 13, 13' move the foil web and can measure the respective path. A printing mark supply device is identified with reference numeral 14. It separates individual printing marks 15 from a printing marks strip 16. As shown in FIG. 1, the printing marks 15, **15*a* are placed onto the synthetic plastic foil web 10. The attachment of the printing marks is performed by an adhesive which is supplied from an adhesive container 17 and applied by an adhesive applying roll 18 on the rear side of the printing marks strip 16. For guaranteeing the application of the printing marks 15, 15*a* at uniform distances, the pair of the pulling rollers 13, 13***a* is connected by a chain 19 with the printing mark supplying device 14.

As shown in FIG. 1, the printing marks are formed as round small pieces. They are arranged on square segments. The segments 20 are composed of a thin synthetic plastic foil or thin paper and connected via perforations 21, 21*a* in the printing marks strip 16. It is to be understood that it is not necessary to have the printing marks strip 16 provided with perforations. Instead, individual segments 20 can be cut out by a cutter. It is also to be understood that the segments 20 must not necessarily be of a square shape. They can be rectangular or also round. Finally, the segments can be formed so small that they substantially correspond to a substantial part or to a whole surface of the printing mark 15. It should be noted that the adhered printing marks must not have a fatigue strength, but instead they serve the purpose of producing or filling a bag, sack or the like.

It is further determined that the point in time at which the printing marks are attached by adherence to the synthetic plastic foil web 10 can be selected to correspond to the local conditions. Thus, the attachment of the printing marks, as shown in FIG. 1, can be performed at an immediate end of the production of the synthetic plastic foil web if it is a hose or after cutting of the hose shortly after the formation of the flat web. Since the adhered printing marks can have an extremely small thickness, the synthetic plastic foil hose with the adhered printing webs or the synthetic plastic flat web with the adhered printing marks can be wound to a roller.

It is also possible to attach the printing marks during the winding of synthetic plastic foil web in a roll, as will be further explained in connection with FIG. 6.

FIG. 1 also shows that a hose 11 is cut by a cutter 22 and subsequently a side seam welding is provided so that two transverse weldings 23, 23' are produced with a separating portion 24 therebetween. The printing marks 15 control a respective width of the produced bag. They control also such features which follow the production of the bag, for example the filling and later closing of the bag.

Figure 2:
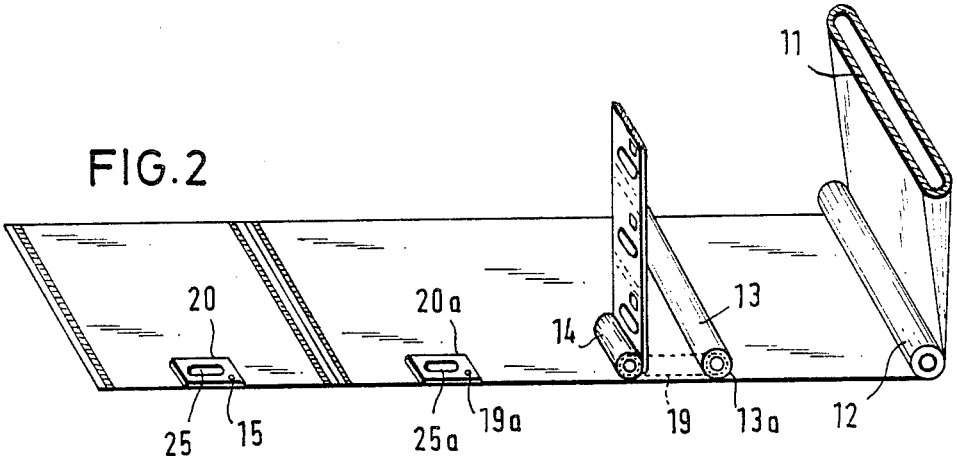
FIG. 2 is a view substantially corresponding to FIG. 1, but showing another embodiment of the present invention.

FIG. 2 shows that the printing marks 15, 15*a* provided on the segments 20, 20*a* are so wide that they serve for gripping edge reinforcements and are provided with gripping openings 25, 25*a* produced by stamping. The gripping reinforcements require a higher foil thickness. They are also attached by adherence. The attachment can be performed in a manner described in relation to FIG. 1. On the other hand, it is also possible to use preprepared adhesive strips with a removable foil.

Figure 3:
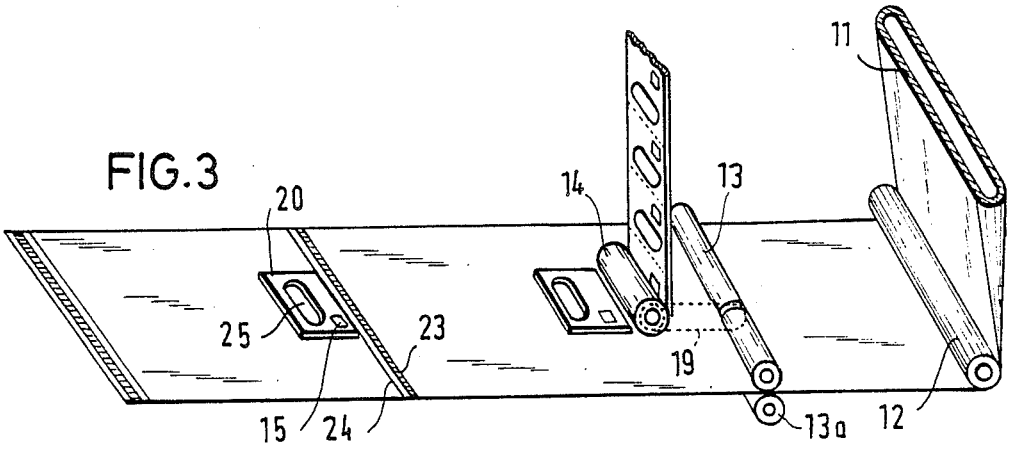
FIG. 3 is a view substantially corresponding to the views of FIGS. 1 and 2, but showing still another embodiment of the invention.

FIG. 3 shows a solution which in principle corresponds to the solution of FIG. 2. However, the printing marks here have rectangular printing surfaces and the gripping edge reinforcements are arranged in the center of a bottom seam bag. The bottom of the bag is provided with a transverse welding seam 23 and a separating cut 24 located near the seam.

FIG. 4 shows a solution which in principle corresponds to the solution of FIG. 3. However, here a supporting pocket is formed from a flat web. The adhered gripping edge reinforcement is arranged at the inner side and also at the outer side of a body of the pocket. These embodiments illustrate that the adhered printing marks can find many applications and can be applied in many arrangements.

FIG. 5 shows an adhered printing mark 15, also in connection with a gripping edge reinforcement for a differently shaped bag.

FIG. 6 shows a bag making machine 26. A supply roller 27 of a synthetic plastic foil web lies on an unwinding block 28. The web 10 passes over a foil compensating swinger 29 with a deflecting roller 30 further over a stationary deflecting roller 31 to the printing marks supplying device 14. The device 14 separates the segments 20 with the printing marks 15 from the printing marks strip 16 and attaches them to the foil web 10. The printing marks supplying device 14 is provided before the pair of pulling rollers 13, 13*a* as considered in the movement direction 32 of the synthetic plastic foil web. The pulling roller 13 is driven and controlled by a chain of the printing marks supplying device. A welding bar 33 supported in holders 34, 34*a* produces transverse weldings 23, 23*a* separated from one another by the separating portion 24. FIG. 6 shows the printing mark which is formed on an adhered gripping edge reinforcement corresponding to the principle shown in FIG. 2.

The adhered printing marks are attached advantageously on foil webs which are not printed. Since, however, there are also synthetic plastic foil webs which have over their surface continuous printing, for example color print or a print with a continuous pattern such as a rectangular pattern or a pattern as in neutral tapestry, the inventive solution can also be advantageously used on so-printed synthetic plastic foil webs. From these webs the bags, sacks and the like can be produced with respective lengths or widths or respective spatial shapes, being controlled by the attached printing marks.

It will be understood that each of the elements described above, or two or more together, may also find a useful application in other types of constructions differing from the types described above.

While the invention has been illustrated and described as embodied in a method of and an arrangement for producing bags, sacks and the like, as well as a bag, sack and the like produced thereby, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A method of producing bags, sacks or similar objects from a thermoplastic synthetic plastic foil web, comprising the steps of providing on a synthetic plastic foil web a plurality of printing marks; electronically sensing the printing marks; and welding and separating the synthetic foil web in response to said sensing of the printing marks, said providing step including forming the printing marks so that they are electronically detectable and arranging the printing marks first on a supporting foil element and then attaching the supporting foil element with the electronically detectable printing marks thereon to the synthetic plastic foil web, said sensing being electronical detecting the printing marks.

2. A method as defined in claim 1, wherein said attaching includes connecting said supporting foil element with said synthetic plastic foil web by adherence.

3. A method as defined in claim 1, wherein said arranging step includes using one long small supporting strip which forms said supporting foil element and arranging said printing marks one after the other on said supporting strip, said attaching step including connecting said supporting strip with the synthetic plastic foil web by adherence.

4. A method as defined in claim 3, wherein said connecting step includes connecting the supporting strip with the printing marks with the synthetic plastic foil web in each section which carries the printing marks so that each section determines the length of the object.

5. A method as defined in claim 3; and further comprising the step of providing an adhesive medium on a rear side of the supporting side with the printing marks, before said connecting step.

6. A method as defined in claim 3; and further comprising the step of providing tearing perforations between the printing marks on the supporting strip with the printing marks.

7. A synthetic plastic foil web for producing bags, sacks or similar objects, comprising a synthetic plastic foil web body; and a synthetic supporting foil which carries a plurality of printing marks to be electronically detected for welding and separating of the synthetic plastic foil web body and which is attached to said synthetic plastic foil web body.

8. A synthetic plastic foil web as defined in claim 7, wherein said supporting foil which carries said printing marks is composed of paper.

9. A bag, sack or a similar object, comprising a body composed of a synthetic plastic foil web; a synthetic supporting foil which carries at least one printing mark to be electronically detected for welding and separating the synthetic plastic foil web and which is attached to said synthetic plastic foil web.

10. A bag, sack, or a similar article as defined in claim 9, wherein said supporting foil which supports said printing mark is composed of paper.

11. A bag, sack or a similar article as defined in claim 9; and further comprising a gripping edge reinforcement attached to said synthetic plastic foil web, said printing mark being carried by said gripping edge reinforcement.

12. A foil strip for supplying printing marks to a bag, sack or a similar object, comprising a supporting strip; a plurality of electronically detectable printing marks arranged at a small distance one after the other on said supporting strip; and a plurality of tearing perforations provided between said printing marks.

13. A foil strip as defined in claim 12, wherein said supporting strip with said printing marks has such a width and a distance between said printed marks that respective portions of said foil strip form on a bag, sack or a similar article simultaneously gripping edge reinforcements.

14. A machine for producing bags, sacks or similar objects of a thermoplastic synthetic plastic foil web, comprising means for supplying a synthetic plastic foil web; means for welding and separating the synthetic plastic foil web; and means for supplying a supporting strip which carries a plurality of printing marks to be electronically detected for controlling said welding and separating means and applying the supporting strip onto the synthetic plastic foil web.

15. A machine as defined in claim 14, wherein said synthetic plastic foil web supplying means includes a supporting block arranged to support a roll of the synthetic plastic foil web, a movement compensating device, and a pair of pulling rollers, said welding and separating means being arranged after said pulling rollers, at least one of said pulling rollers being associated with said printing mark supplying means.

16. A machine as defined in claim 15, wherein said at least one pulling roller is provided with a drive which drives said printing marks supplying means.

* * * * *